US008282805B2

(12) United States Patent
Daigle

(10) Patent No.: US 8,282,805 B2
(45) Date of Patent: Oct. 9, 2012

(54) PROCESS AND APPARATUS FOR CLEANING AND/OR COATING CONDUCTIVE METAL SURFACES USING ELECTRO-PLASMA PROCESSING

(76) Inventor: Edward O. Daigle, Baton Rouge, LA (US)

( * ) Notice: Subject to any disclaimer, the term of this patent is extended or adjusted under 35 U.S.C. 154(b) by 883 days.

(21) Appl. No.: 11/718,504

(22) PCT Filed: Nov. 2, 2005

(86) PCT No.: PCT/US2005/039986

§ 371 (c)(1),
(2), (4) Date: Nov. 14, 2008

(87) PCT Pub. No.: WO2006/078338

PCT Pub. Date: Jul. 27, 2006

(65) Prior Publication Data

US 2009/0120797 A1 May 14, 2009

Related U.S. Application Data

(60) Provisional application No. 60/624,469, filed on Nov. 2, 2004.

(51) Int. Cl.
*C25D 5/00* (2006.01)

(52) U.S. Cl. ..... 205/87; 204/164; 205/137; 205/138

(58) Field of Classification Search ..... 205/87
See application file for complete search history.

(56) References Cited

U.S. PATENT DOCUMENTS 4,601,794 A * 7/1986 Tsuda et al. ..... 205/130
6,585,875 B1 * 7/2003 Ryabkov ..... 205/87

* cited by examiner

*Primary Examiner* — Harry D Wilkins, III
*Assistant Examiner* — Bryan D. Ripa
(74) *Attorney, Agent, or Firm* — Warner J. Delaune; Baker Donelson, et al.

(57) ABSTRACT

An improved process for treating an electrically conductive surface of a workpiece by cleaning or coating the surface is provided, comprising the steps of deploying the electrically conducting surface of the workpiece to form a cathode in an electrolytic cell; establishing a DC voltage between the cathode and an anode; forming a working gap between the anode and the cathode, and establishing a seal around the working gap to form a sealed treatment zone; delivering into the working gap an electrically conductive medium selected from the group consisting of: (A) an aqueous electrolyte from which a foam is created; (B) a foam; and a mixture of components (A) and (B), so that electrically conductive medium consisting of a foam comprising a gas/vapor phase and a liquid phase fills the working gap, wherein said electrically conductive medium enters the electrolytic cell through tubes having discharge ends oriented at approximately ten degrees from parallel to the workpiece, and wherein turbulence is created within the electrolytic cell; adjusting the operating parameters so that an electro-plasma discharge is created between the cathode and positive ions in the electrically conductive medium which are concentrated near the electrically conducting surface of the workpiece, thereby causing micro-zonal melting of the surface; and removing foam from the working gap.

1 Claim, 2 Drawing Sheets

PROCESS AND APPARATUS FOR CLEANING AND/OR COATING CONDUCTIVE METAL SURFACES USING ELECTRO-PLASMA PROCESSING

RELATION TO PRIOR APPLICATIONS

This nonprovisional application is based on prior provisional application Ser. No. 60/624,469, filed on Nov. 2, 2004.

BACKGROUND OF THE INVENTION

I. Field of the Invention

The present invention is an improved process and apparatus for cleaning and/or coating conductive metal surfaces using electro-plasma technology.

II. Background Art

Metals, ferrous and non-ferrous, usually need to be cleaned and/or protected from corrosion. As produced, steel normally has a film of mill oxide scale on its surface which is not uniformly adherent and renders the underlying material liable to galvanic corrosion. In most industrial applications this oxide scale must be removed and the underlying exposed metal coated against further oxidation, i.e. rust. Metals can also have other forms of contaminants, such as oils, chemical rust inhibitors, chemical polishing or buffing agents, grease, paint or simply dirt, which must be removed before industrial use.

Traditional methods of cleaning metals include acid pickling, which is environmentally unfriendly and requires huge volumes of fresh water to neutralize, grit or steel shot air and/or centrifugal blasting, salt or caustic bath cleaning, alkaline cleaning, mechanical brush cleaning or ultra high pressure water blasting. Bi-polar ultra-sonic cleaning will typically incorporate some chemical to enhance the process. Electrolytic cleaning involves the use of alkaline cleaning solutions and the polarity may be alternated. These electrolytic processes typically use low voltage (3 to 25 volts) with current densities of 1 to 20 Amps/dm$^2$. In these processes, when the workpiece is the cathode, the surface may not only be cleaned but also "activated", thereby giving any subsequent coating an improved adhesion. Electrolytic processes are not normally economically viable and in most cases cannot remove tenacious oxide scales.

Conventional electrolytic cleaning and plating processes operate in a low-voltage regime in which the electrical current increases monotonically with the applied voltage. In these conventional electrolytic processes, cleaning and/or plating, the generation of gas bubbles on the cathode do not, in any circumstance, experience the generation of plasma. In conventional electrolytic processes the increase in voltage produces many bubbles at the cathode surface, due to intensive electrolysis of the solution and liberation of Joule heat. At this stage the cell voltage-current characteristics conform to Ohm's Law. As voltage is increased, at some point the vapor inside the bubble is broken down and a spark discharge is observed. Continued voltage increase causes the spark intensity to increase. In this zone, known typically as an unstable region, the initiation of arc-discharge plasma is observed. Continued increase in voltage, above another point, a continuous glow occurs and remains as voltage increase continues, and in this region, current increases as voltage increases until a point is reached where electrical arcing occurs, which marks the termination of the plasma discharge region.

Prior patents such as UK-A-1399710, U.S. Pat. No. 5,958,604, U.S. Pat. No. 5,981,084, U.S. Pat. No. 5,700,366 and U.S. Pat. No. 6,585,875 in the field of electrical plasma processing (cleaning and coating) employ high voltage and operate in an electrical regime in which the current decreases or remains essentially the same as voltage is increased and are characterized by the formation of plasma at the onset of the unstable region.

In the current improved process the operating regime is substantially changed and has shifted out of the unstable region and operates in a region where as voltage is increased amperage also increases.

UK-A-1399710 teaches that the gas film must be continuous and the electrical regime which describes the current as decreasing or remaining fairly constant as voltage is increased described the "unstable regime" characterized as the descending half of the first current increase curve.

GB-A-1399710 teaches that a metal surface can be cleaned electrolytically without over-heating and without excessive energy consumption if the process is operated in a regime just beyond the unstable region, the "unstable region" being defined as one in which the current decreases with increasing voltage. By moving to higher voltages, where the current increases with increasing voltage a continuous film of gas/vapor is established over the treated surface, effective cleaning is obtained. Energy consumption is high (10 to 30 KWh/m$^2$) as compared to the energy consumption required for acid pickling (0.4 to 1.8 KWh/m$^2$).

SU-A-1599446 describes a high voltage electrolytic spark erosion cleaning process for welding rods which uses extremely high current densities, on the order of 1000/A/dm$^2$, in a phosphoric acid solution.

SU-A-12244216 describes a micro-arc cleaning treatment for machine parts which operates at 100 to 350 volts using an anodic treatment. No particular method of electrolyte handling is taught.

JP-A-08003797 and DE-A-4031234 describes the use of high speed jets of electrolyte situated near the electrodes in the electrolytic cleaning baths to create high speed turbulent flow in the cleaning zone, but does not enter into the unstable region or utilize plasma creation.

EP-A-0037190 teaches the use of a single jet of electrolyte, without immersion of the workpiece, for cleaning radioactive contamination. The workpiece is anodic and the voltage is between 30 and 50 volts. Removal of the oxide is held to be undesirable.

EP-A-0406417 describes a continuous process for drawing copper wire from copper rod in which the rod is plasma cleaned before the drawing operation. The "plasmatron" housing is the anode and the wire is also surrounded by an inner co-axial anode in the form of a perforated U-shaped sleeve. In order to initiate plasma production the voltage is maintained at a low but unspecified value, the electrolyte level above the immersed wire is lowered, and the flow-rate decreased in order to stimulate the onset of a discharge at the wire surface. Low-voltage electrolytic cleaning is widely used to prepare metal surfaces for electro-plating or other coating treatments, these processes cannot remove mill oxide scales without unacceptably high energy consumption.

Such electrolytic cleaning processes must normally be used in conjunction with other types of cleaning processes, in a multi-stage operation.

WO-A-97/35052 describes an electrolytic process for cleaning electrically conducting surfaces suing an electro-plasma (arc-discharge) in which a liquid electrolyte flows through one or more holes in a anode held at high DC voltage and impinges on the workpiece (cathode) thus providing and electrically conductive path. The system is operated in a regime in which the electrical current decreases or remains substantially constant with increase in the voltage applied between the anode and the cathode and in a regime in which discrete bubbles of gas and or vapor are present on the surface of the workpiece during treatment.

WO-A-97/35051 describes an electrolytic process for cleaning and coating electrically conducting surfaces which is similar to the process described in WO-A-97/35052 except that the anode comprises a metal for metal coating of the surface of the workpiece.

In WO-A-97/35051 & 35052 an arc discharge or electro-plasma is formed on the surface of the workpiece and is established within the bubble layer. The plasma has the effect of rapidly removing mill-scale and other contaminants from the surface of the workpiece, leaving a clean metal surface which may also be passivated (resistance to corrosion). If the anode is constructed from a non-inert materials, such as a non-refractory metal, then metal atoms are transferred from the anode to the cathode, providing a metal coating on the cleaned surface.

Coating may also be achieved under the regime of operation described above by using an inert anode and an electrolyte containing ions of the metal to be coated as described in WO-A-99/15714. In this case the process becomes a special form of electroplating, but because it occurs at high voltage in the presence of an arc discharge the plating is faster than normal electroplating and the coating has better adhesion to the substrate metal.

U.S. Pat. No. 4,360,410 Fletcher et al. describes the use of foam for an improved electroplating process. This is a typical electroplating process where low voltage is utilized for ion transfer, without arc discharge or plasma generation. Fletcher et al operates in a different electrical regime which is typical of conventional electrolytic processes. The importance of Fletcher et al is the verification that foam improves uniformity.

WO-A-98/32892 describes a process which operates essentially in the manner described in WO-A-99/15714 but uses a conductive gas/vapor mixture as the conductive medium. This gas/vapor mixture is generated within a two or multi-chambered area before being ejected into the working gap through holes in the anode plate. The gas/vapor mixture is generated by heating an aqueous electrolyte within the anode chambers (chambers adjacent to the anode plate, above or below the anode plate itself) to the boiling point or above, and the anode chambers may be heated either by the main electric current or by independent electrical heaters.

WO-01/09410 A1-U.S. Pat. No. 6,585,875-describes a process similar to WO-A-98/32892 and WO-A-99/15714 and claims an improved process in which, an electro-plasma (arc-discharge) is employed to clean and/or apply a metal coating to an electrically conductive surface. For example steel, in which the electrically conductive pathway is provided by a foaming electrolyte which fills the space between the anode and the cathode and provides advantages with respect to lower power consumption, more uniform surface treatment and greater latitude in the size of the gap between the anode and the workpiece.

U.S. Pat. No. 6,585,875 teaches an improved process in which arc-discharge electro-plasma is employed to clean and/or apply a metal coating to an electrically conductive surface, in which, the electrically conductive pathway is provided by a foaming electrolyte which fills the space between the anode and the cathode and provides advantages with respect to lower power consumption, more uniform surface treatment and greater latitude in the size of the gap between the anode and the cathode.

The present process has changed the creation (foam & plasma) of the process substantially both from the mechanical aspect, by creating a very simple device to utilize the process, and changes the internal mechanism for electrolyte delivery. It also changes the mechanics of foam creation, enhances ionization and causes the use of turbulence to enhance foam creation, foam density, increases plasma evolution, removes debris from the work chamber, and stabilizes the plasma by utilizing a denser foam which stabilizes the gas envelope, which forms around the workpiece. The changes create a more user-friendly apparatus, which allows for greater commercialization by creating the ability to process multiple work-pieces inline without the need for specialized machine parts and reduces or eliminates wear parts. The new process, which is an improved embodiment of rapid advancements in the field of electro-plasma processing also creates a multi-functional process which has the potential to reduce or eliminate the need for environmentally unfriendly chemicals, such as zinc-phosphate to be used as lubricant carriers in the metals industry. The advancements also create the ability to use heretofore waste materials to become useful, commercial products.

SUMMARY OF THE INVENTION

A specific object of the invention is to provide improvements in continuous-circulation electro-plasma processing for cleaning of metals (ferrous & non-ferrous) and to improve the ability to apply conductive metal coatings to conductive metal substrates. The improvement, by increasing ion generation and excitement, increases the efficiency of the cleaning process by increasing the formation of hydrogen plasma within the gas envelope, by increasing the efficiency through better control of the boundaries of the gas envelope, which is a result of denser foam which also increases overall efficiency and stability of the plasma and its formation.

For coatings, using the electro-plasma process the same conditions as for cleaning exist which enhance the coating quality, deposition rate and the ability to apply the coating itself. Increased coating uniformity, that is, a more equal distribution of the coating over the entire workpiece surface is now attainable.

The improvement lies in the ability to more completely fill the work chamber with foam. The foam is more dense than the foam density of previous electro-plasma processes and the use of a simple mechanical device and the creation of a new method for electrolyte introduction into the work chamber, which cause turbulence within the reaction chamber which does not exist with previous electro-plasma processes. The use of a screen which is impervious to liquid, but which allows air to freely flow through greatly enhances the ability to create foam either alone of in conjunction with the applied electrical current.

The improvements embody similar techniques as those used in standard electroplating practices for noble metals, [Fletcher et al] but differs in that the electro-plasma process uses arc-discharge and glow discharge plasma as the process vehicle. The process is different from standard electroplating processes in that the electro-plasma process uses high voltage, while standard electroplating processes use low voltage.

Most significantly, standard electroplating or electrolytic-cleaning processes do not create plasma (arc-discharge/glow discharge).

The improvements, cause surface melting in a micro-zone, i.e. a very thin layer measured in nanometers, on the surface, while standard electrolytic processes do not. The improvements embody simplicity over previous inventions in the field of electro-plasma processes by use of specialized flow techniques for increased plasma generation and increased foam density, without the use of external foam generators.

Existing plasma processes can utilize inert gas to improve foam density, however, the complexity of the internal apparatus causes this application to be very difficult. Gas when utilized to help create greater foam density can be mixed with the electrolyte in a pressurized chamber outside of the reaction zone and then pumped normally into the reaction zone. Due to the simplicity of the new device, the gas, can be diffused through any number of existing commercial gas diffusers, such as an aquarium oxygen diffuser, as an example. Due to the rapidly expanding gas within the reaction chamber, and the placement of the vents, a natural lifting action occurs and evacuates the foam and contaminants from the reaction chamber while the gas is vented to atmosphere.

Due to the simplicity of the improved apparatus the ability to now commercially process multiple lines is available while previous apparatus reduce or eliminate this ability due to complexity, the need to "thread" the reactor and the sheer physical size of the apparatus.

Therefore, an improved method of treating an electrically conductive workpiece is provided wherein a work piece (cathode) to be cleaned, coated, machined, polished or surface modified is placed, statically or dynamically moving through the reaction zone in proximity to an anode(s) are newly created cylindrical tubes, or curved or flat plates with focused points, or a combination thereof which causes the electrical current to be focused (directed power density) specifically toward the work piece in a more uniform manner. The electrolyte enters the work zone through the same tubes used as positively charged anodes, under pressure, in which one or more of the tubes are placed at a 10 degree angle from parallel to the work piece, while the remaining anodes remain parallel to the work piece. The flow, under pressure, through the anode tubes creates turbulence with the reaction zone and this turbulence causes or forces a greater volume of electrolyte to pass over and around the anode with increased surface area due to configuration, which in turn excites the movement of positive and negative ions. The combination of turbulence, focused electrical fields, and greater surface area of the anode face causes the formation and/or creation of a dense or denser foam within the reaction zone and with the focused electrical fields and turbulent flow, enhancing plasma formation, thus increasing plasma intensity.

The turbulent flow of electrolyte, the direction of the electrolyte flow and the angle of entry of the electrolyte, causes plasma to form more rapidly on fast moving objects, which overcomes the condition of "plasma-drag" which is caused when surface tension of fast moving objects through the work-chamber, and does not allow plasma to form at the entry end of the work-zone. The speed at which "plasma-drag" occurs is proportional to the surface area, surface roughness, and surface wetting ability. At relatively low speeds plasma-drag can extinguish an area of plasma, depending on travel speed, and at very high speeds, which are typical in many industrial applications, extinguish most, if not all of the plasma formation. In earlier foam processes, this phenomenon was partially overcome by drastically increased flow rates and increased power input.

The turbulent flow of electrolyte creates the ability to machine and/or polish the surface of the workpiece. Control of the area to be machined is by flow direction in relation to the workpiece or by masking the area not to be machined with a non-conductive tape, which tape is typical in the electroplating industry.

The surface profile created when oxides are removed or the surface profile created when other contaminants such as oils, paints, lubricants, and/or preservatives are removed with longer treatment times, the micro-relief or profile created very closely approximates the micro-relief or profile created by the use of environmentally unfriendly chemicals which are required as lubricant carriers for drawing processes. The micro-relief or profile created by the plasma process substantially reduces or eliminates the need for these chemicals as lubricant carriers by providing a natural micro-relief or profile which will pick up and carry the necessary lubricants.

In an alternate embodiment, the pressure within the work zone is near atmospheric.

The use of conductive tubes as anodes creates the ability to pump foam directly into the reaction zone without the necessity to go through specially heated screens, collection chambers, or flow through multiple holes in the anode for heating necessary to create the foam within the electrolyte.

In addition, the use of conductive tubes as anodes provides a greater temperature range for operating the process. When electrolyte is forced through heated screens and through multiple holes in the anodes, the heat electrolyte is boiled, and as the heated screen or anode plates reached elevated temperatures, the affect is the breakdown of the electrolyte foam into pressurized steam. There is not enough liquid in steam to carry a stable conductive path. This causes instability or a reduction in the ability for plasma to form on the work piece. The use of conductive tubes allows for foam to be directly pumped into the work chamber or for liquid electrolyte to form foam within the work chamber as a natural reaction of the process, thus allowing for a substantially greater operating temperature range.

The electrical regime in which the process operates is at a point where amperage remains relatively constant or increases slightly as voltage is increased. Optionally, the electrical power input can be reversed and the process made anodic, wherein oxides of metals can be applied to conductive metals.

The control, modification and/or alteration of metal surfaces can be created within the parameters of the process, but utilizing other chemicals to form the electrolyte, which substantially increase and alter the operating parameters for surface modification. Materials, ferrous or non-ferrous, conductive plastics and glass can have their surface altered or modified.

The process may also use other chemicals as electrolyte for surface modification which substantially alters or modifies the surface for adhesive enhancement of clad materials, such as rubber, plastics or other metals.

In one embodiment, the method operates an aqueous plasma process at the "extreme" end of the electrolysis curve where the typical rules and reaction expectations are altered and circumvented. The plasma process creates a process where the combinatorial parameters of moderate to high temperatures and moderate to high pressures dramatically affect the kinetics and efficiencies of a typical chemical reaction. Typical electrolysis, uses low pH acid-sulfate electrolytes which are unsuitable for aqueous plasma electro-deposition. A new family of electrolytes will be created with aqueous plasma processing.

In another embodiment, a semi-impervious-to-liquid screen is situated under an anode, and pressurized with air, which causes a dense foam to form around and over an anode made of one or more metals or a combination of metal plates that erode causing the deposition of a coating from the eroding anode plates in a uniform even distribution of the conductive electrolyte in a uniform manner around the workpiece. An additional anode or cathode may be located under the lower anode or cathode (screen semi-impervious to liquid)

which causes a dense foam to form when electrolyte is introduced into the chamber above the screen which dense foam promotes the deposition rate for coatings and provides a stable, even distribution of metal ions to the workpiece. This lower anode or cathode can be operated at a substantially lower voltage than the upper anode thus assisting in the formation of foam by the voltage differential within the reactor.

In an alternate embodiment, the work chamber is a simple cylinder or rectangle which does not require multiple electrolyte chambers, heated screens or collection chambers. The work chamber may be a simple cylinder or rectangle without the necessity of intricate flow channels, gas expansion chambers or complicated venting systems.

The apparatus allows for the ability to hinge and open as two halves, which allows for the easy loading of a work piece and/or easy maintenance within the work chamber, in a safe manner, which meets the requirements of industrial applications for multiple line processing. It should be small enough to be used for multiple line processing and able to be isolated electrically one from another, and it should permit the ability in multiple line processing to safely shut off the electrical power to a single reactor, without shutting off the power to all reactors.

The apparatus substantially differs from previous electroplasma devices in that gas ports or vents are in-line with the work piece and not on the sides as in earlier devices. The stability of the plasma created by the foaming electrolyte is destroyed by venting of gas from side ports. This effect is created when the workpiece becomes wide enough to cause the created gas to move outward along the transverse axis of the workpiece, thus creating a "pulling" affect on the plasma causing instability and inconsistency. By altering and/or modifying the apparatus by placing the gas ports for venting along the longitudinal axis of the workpiece, plasma is pulled in the same direction as that of the workpiece causing stability and consistency.

In another embodiment, the apparatus utilizes a semi-impervious (to liquid) screen under which air is injected from the underside of the screen and electrolyte is introduced above the screen, which causes a dense foam to form, which passes around and over a positively charged anode which is comprised of one or more metal plates (anodes) causing an even distribution of conductive foam to carry the metal(s) ions for deposition to the workpiece (cathode). Also, the anodes may be made from the material to be coated to the workpiece, thus increasing the metal ions available for coating to the workpiece. This apparatus allows for the insertion of sacrificial anodes in a continuous feed or by a simple change of the anode itself.

DETAILED DESCRIPTION OF THE INVENTION

In the existing state of electro-plasma processing, electrolyte in a liquid state is pumped into a sealed chamber, which has access to numerous openings holes in an anode plate and this liquid flows through these openings into a work space comprised of two or more chambers, one lies within the inner diameter of the anode and the second is a much larger chamber for collection of the expanding gasses. From the gas chamber, the gas/vapor/liquid which is in this area is vented through multiple openings which allow for venting of the gas, and condensation of the vapor back to liquid, then returned to the electrolyte tank. The electrolyte enters the work-space perpendicular to the workpiece and is sprayed onto the workpiece surface. Foam is formed within this chamber.

The existing foam plasma invention requires numerous machined parts each requiring special rubber seals to maintain individual entry and exit chambers for the electrolyte and gas/vapor. These individual apparatus of internal bodies comprise a very complex and expensive apparatus, which eliminates the ability to open the reaction chamber easily for routine maintenance, causes the need for special tools to "thread" a workpiece and in short causes difficulty in routine operations. Another major drawback of the existing plasma process which is solved by the new invention, is the accumulation of contaminants in the lower portion of the gas chamber, which contaminants build to a level where arcing is possible and flow disruptions occur. This cannot occur in the new invention due to the turbulent flow of electrolyte.

I. THE IMPROVED PROCESS

Figure 1:
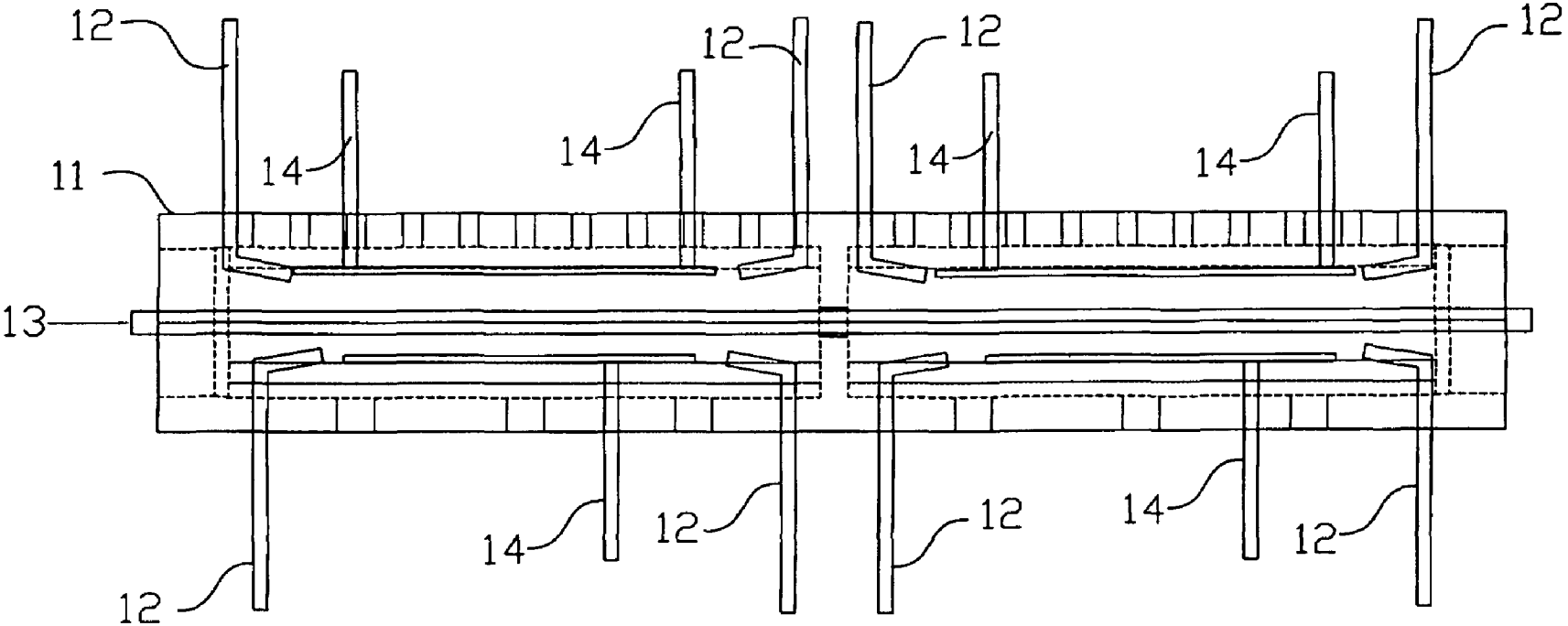
FIG. 1 is a schematic diagram depicting the reaction chamber and workpiece, as well as the tube anodes used for delivery of the electrolyte.
Figure 2:
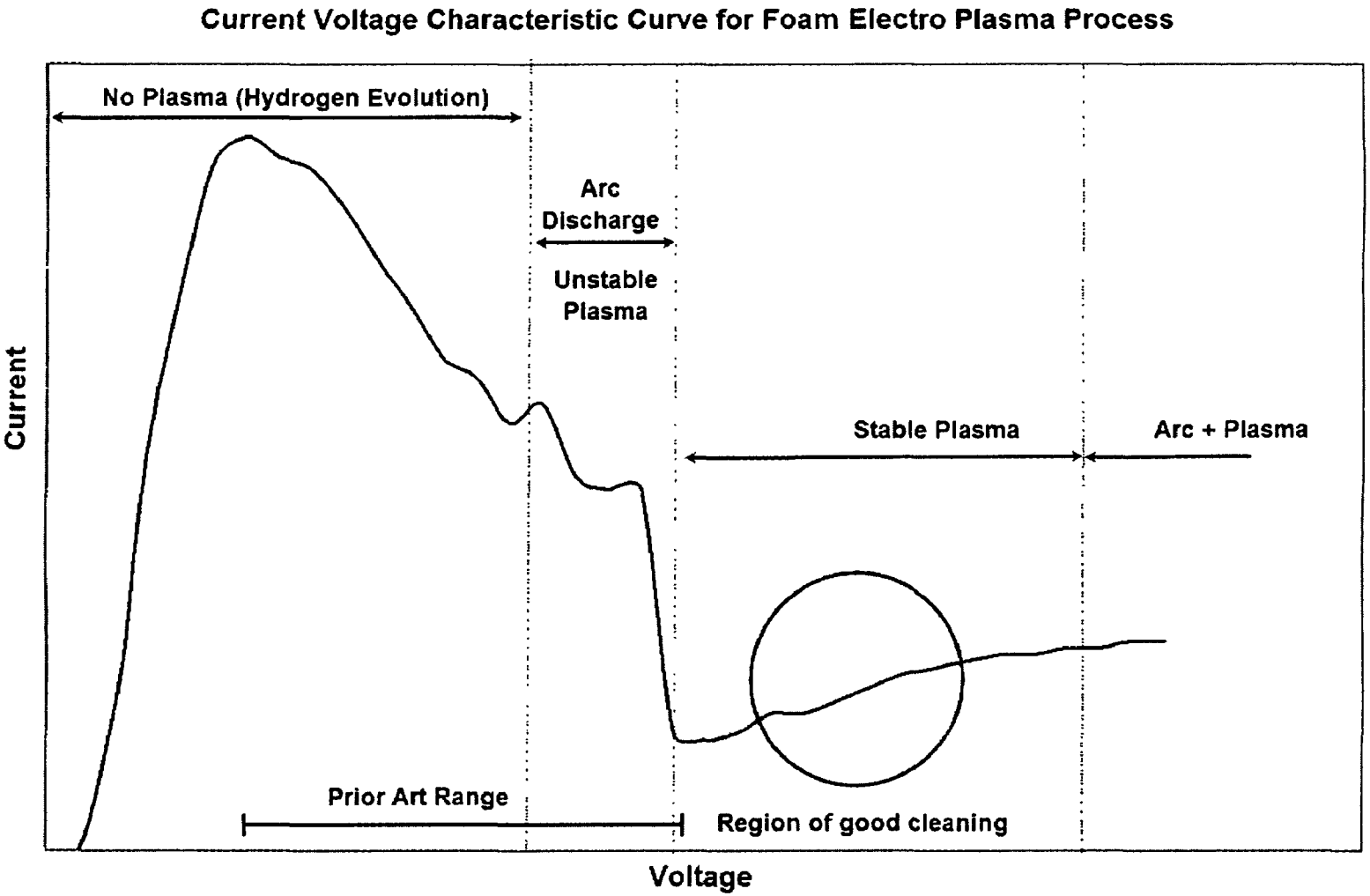
FIG. 2 is a graph illustrating a current and voltage characteristic curve for a foam electroplasma process, depicting the region for good cleaning in comparison to prior methods.

In accordance with a preferred embodiment of the improved process and referring to FIGS. 1 and 2, a conventional liquid electrolyte is introduced into a work chamber 11 through tubular anodes 12 or inert tubes, which are aligned above and below the workpiece 13.

Further, these tubes 12 are designed to move electrolyte into the workspace 11, horizontal to the workpiece 13 and flow in the opposite direction of the workpiece travel. Tubes which lie between the entry and exit ends of the work chamber 11 are angled at about 10 degrees past horizontal and up to about 10 degrees off the center line of the workpiece 13, which causes increased turbulence and excitement of positive ions moving toward the workpiece surface. The new invention, by the use of tubes 12, causes a major alteration in the dynamics of the process.

The apparatus is comprised of a hollow chamber 11, round, square or rectangle, in shape, which is proportional in area volume to the cross-section area of the workpiece 13. The area of the anode surface is proportional to the area of the cross-section of the workpiece 13, therefore the proportion between the hollow chamber 11, the anode 14 and the workpiece 13 all comprise a standard for duplication of the apparatus and duplication of results. The tubes 12 for introducing the electrolyte into the chamber 11 may be positively charged, making them the anodes or part of the sacrificial metal for coating, or they can be inert material, in which case they simply act as the conduit for introducing electrolyte into the reaction chamber 11.

The ends of the workpiece chamber are sealed by use of mechanical seals or air seals which when turned 90° to each other, form a V-notch opening for inserting a round workpiece 13 when the reactor is opened. The reactor is divided into two halves which are hinged on one side and secured by latches on the opposing side for closure. An O-ring seal seals the two halves when closed and latched. For flat or square materials, the seals will be part of each halve of the reactor 11 itself and will not require any special apparatus for sealing around the workpiece 13. The use of air or inert gas seals allows for the coated materials to be rinsed and dried prior to exiting the reactor 11, which allows for materials that are reactive with air and water to be neutralized prior to exiting the reactor 11, thus allowing for the application of materials, such as aluminum, from an aqueous solution.

The new plasma process allows for greater control over the physical application of the plasma, by creating the ability to apply plasma to a single spot or side or area of a workpiece 13 which is not possible with the existing plasma apparatus. The new plasma process allows for the creation of "portable" units and gives the user the ability to easily process "parts & pieces" of materials.

A further embodiment of the new process is the reclaiming and use of waste materials such as copper. As copper is cleaned with the process, the metal ions concentrate in the electrolyte solution, which would typically be a hazardous waste material. With the plasma process, this heretofore waste material can be concentrated and used in the process to apply or enhance a coating application of copper, or when mixed with zinc, a coating of brass.

A further embodiment of the new process and a major advancement is the geometric design of the anodes 12, 14 which provides control and predictability of the current distribution over the workpiece 13 (cathode) surface which creates greater uniformity in the power density, which is the primary control of plasma stability and efficiency. The embodiment of this advancement lies in the anode geometry and placement within the reaction cell 11. By altering the anode geometry and placement, the current density is now equalized and current density vectors remain equal and parallel between the anode and cathode. This change is evident in cleaning but substantially more significant in coating applications where uniformity is more necessary for equal distribution of metal ions. HL Pinkerton, Current and Metal Distribution Electroplating Engineering Handbook, Fourth Edition, Van Nostrand-Reinhold Co. 1984 teaches that the geometry of the system sets the stage for the current distribution in the plating solution. Providing uniform distribution of current density at the cathode (workpiece to be plated) and non-uniformity in the current density usually cannot be overcome by secondary variables. J B Mohler, Plating Cells Metal Finishing 1990 Guidebook and Directory, Vol 88 No 1A., Z A Wade, CSSP AESF 2002, Application of Finite Element analysis to the Evaluation of Electroplating Systems. By flowing electrolyte against the direction of travel, plasma-drag, which occurs on previous inventions, does not occur.

A further embodiment of the invention is that the process allows for the electrochemical machining of articles of conducting materials. This machining process is made possible in the new invention by the geometric design of the anode and the ability to direct and control the turbulent flow of electrolyte at the work piece. Additionally, by simple masking of the cathode, specific areas can be machined. After removal of typical mill oxide scale, the profile typically ranges from 15 μm to 30 μm, peak to valley and as this area is subjected to additional processing, the peaks and the spheroids which are typical of plasma processing are reduced causing greater smoothness, and reflectivity to light.

A further embodiment of the invention is the ability of the treated surfaces, where mill oxide scale has been removed, to act as a lubricant carrier due to the profile created (surface texturing) when mill oxide scale is removed. This embodiment can have significant industrial and environmental impact by potentially reducing or eliminating the need for the application of zinc-phosphate which serves as a lubricant carrier by creating micro-relief roughness. It is this roughness, or "surface texturing", which serves to carry lubricants such as borax into the drawing process.

II. EXAMPLES OF USE OF THE INVENTION

The following non-limiting examples will illustrate the various embodiments of the invention.

Example 1

A continuous high-carbon steel wire, 1.72 mm in diameter, with a tenacious "patenting" oxide scale covering the base metal surface as a tight, bright black oxide material [scale] which in turn is covered by a loose layer of carbon, created in the patenting furnace as the drawing lubricants and carrier chemicals are burned as the wire passes through the furnace for annealing was moved through the reactor and a DC voltage applied. As electrolyte entered the reactor through conductive tubes, at 90 VDC, plasma formed on the surface of the cathode and with a dwell time of approximately 1 second in the reactor, the carbon layer and the oxide scale were removed, exposing the base cleaned metal.

| | |
|---|---|
| Electrolyte Temperature | 78° C. |
| Electrolyte Concentration | 10% $NaHCO_3$ pH: 8.5 |
| Electrolyte Flow Rate | 1.25 L/min nominal flow rate |
| Travel Speed | 9.15 m/min |
| Reactor Length | 66 cm |
| Plasma Zone [active length] | 52 cm |
| Voltage DC Range | 135/90 VDC |
| Amperage Range | 34/18 A |

Example 2

A continuous high-carbon steel wire, 1.72 mm in diameter, with all contaminants as described in Exp. 1 removed, exposing a base metal surface free from oxide scale and other contaminants was moved through the reactor and a DC voltage, of 150 VDC was applied. As electrolyte entered the reactor through conductive tubes, plasma formed on the surface of the steel wire and a continuous, homogeneous nickel coating was applied.

| | |
|---|---|
| Electrolyte Temperature | 70° C. |
| Electrolyte Concentration | 16% $NiSO_4$ (3.8% Ni) pH: 3.5 |
| Electrolyte Flow Rate | 1.5 L/min nominal flow rate |
| Travel Speed | 6.7 m/min |
| Reactor Length | 66 cm |
| Plasma Zone [active length] | 52 cm |
| Voltage DC Range | 165/145 VDC |
| Amperage Range | 42 |
| Deposition Rate: | 1 μm/4 seconds dwell |

Example 3

A continuous high-carbon steel wire, 1.72 mm in diameter, with all contaminants as described in Exp. 1 removed, exposing a base metal surface free from oxide scale and other contaminants was moved through the reactor.

The electrical polarity was changed from cathodic to anodic, that is the anode became earth and the cathode or workpiece became positive. The cleaned steel wire was moved through the reactor and DC voltage applied. The visible plasma, within the reactor changed from a violet/orange to a dark brownish/green color. A nickel oxide was applied to the surface of the cleaned steel wire. The oxide deposited on the wire surface was dark brown in color while the material deposited on the anodes was comprised of two layers, and outer layer of brown material and an inner layer of green material.

| | |
|---|---|
| Electrolyte Temperature | 80° C. |
| Electrolyte Concentration | 16% $NiSO_4$ (3.8% Ni) pH: 6.0 |
| Electrolyte Flow Rate | 1.5 L/min nominal flow rate |
| Travel Speed | 6.7 m/min |
| Reactor Length | 66 cm |
| Plasma Zone [active length] | 52 cm |
| Voltage DC Range | 200 VDC |
| Amperage Range | 15 A |
| Polarity: | Anodic |

Example 4

A reinforcing steel rod with a diameter of 0.625" with a heavy mill scale oxide, approximately 35 μm thick was passed through a reactor with a length of 12" in which plasma removed the oxide scale exposing the base metal including the ridges and lettering on the rod. The clean surface exhibited the typical plasma profile.

| | |
|---|---|
| Electrolyte Temperature | 80° C. |
| Electrolyte Concentration | 10% $NaHCO_3$ |
| Electrolyte Flow Rate | 2.5 L/min nominal flow rate |
| Travel Speed | 1 fpm |
| Reactor Length | 30 cm |
| Plasma Zone [active length] | 26 cm |
| Voltage DC Range | 180 VDC mperage Range 35 A |
| Polarity: | Cathodic |

Example 5

A reinforcing steel rod, as in example 4, with a diameter of 0.625" which was cleaned in Exp. 4, all mill scale removed was passed through a reactor with a length of 12" in which plasma formed and a coating of zinc was applied to the clean base metal. The coating was dense and ductile and very well adhered to the base metal. Iron was alloyed into the zinc coating, with iron being found very near the surface of the zinc coating.

| | |
|---|---|
| Electrolyte Temperature | 75° C. |
| Electrolyte Concentration | 16% $ZnSO_4$ |
| Electrolyte Flow Rate | 2.5 L/min nominal flow rate |
| Travel Speed | 3 fpm |
| Reactor Length | 30 cm |
| Plasma Zone [active length] | 26 cm |
| Voltage DC Range | 200 VDC |
| Amperage Range | 40 |
| Deposition Rate: | 1 μm/second |

Example 6

A wire rod, 5.5 mm in diameter, having been previously cleaned with the electro plasma process is passed through a reactor with a length of 12" in which plasma formed and a coating of nickel was applied to the clean base metal. The coating was dense and ductile and showed little or no porosity.

| | |
|---|---|
| Electrolyte Temperature | 75° C. |
| Electrolyte Concentration | 16% $NiSO_4$ (3.8% Ni) pH: 3.5 |
| Electrolyte Flow Rate | 2.5 L/min nominal flow rate |
| Travel Speed | .5 fpm |
| Reactor Length | 30 cm |
| Plasma Zone [active length] | 26 cm |
| Voltage DC Range | 200 VDC |
| Amperage Range | 45 |
| Deposition Rate: | .5 μm/second |

Example 7

A fine wire having a diameter of 150 μm and having a brass coating was passed through a reactor with a length of two (2) inches with plasma forming on the wire surface. The surface of the wire was modified from the original state, without removing the existing coating.

| | |
|---|---|
| Electrolyte Temperature | 75° C. |
| Electrolyte Concentration | 8% $NaHCO_3$ |
| Electrolyte Flow Rate | 0.25 L/min nominal flow rate |
| Travel Speed | 15 fpm up 150 fpm |
| Reactor Length | 5 cm |
| Plasma Zone [active length] | 3.8 cm |
| Voltage DC Range | 90 VDC [stable condition] |
| Amperage Range | 0.75/1.5 |

Example 8

A wire rod with a diameter of 5.5 mm, having been cleaned with the electro plasma process, seventeen (17) days prior was drawn to a finish diameter of 1.72 mm without the use of a chemical lubricant carrier. The rod was passed through a open lubricant box, containing a dry powder lubricant. Approximately 2,500 meters of rod was drawn without a break and SEM analysis revealed a clean surface with only longitudinal lines.

| | |
|---|---|
| Lubricant Carrier: | None |
| Lubricant | Dry powder |
| Entry Speed: | 32 m/min |
| Exit Speed: | 800 m/min |
| Number of Dies: | 12 |

Example 9

A wire rod with a diameter of 5.5 mm, having a coating of melted zinc-phosphate, borax and covered with a sterate was passed through a reactor with a length of 2.5 meters and plasma formed on the surface. SEM and EDAX analysis showed that almost all (99%) of the contaminants were removed from the surface of the wire rod.

| | |
|---|---|
| Electrolyte Temperature | 78° C. |
| Electrolyte Concentration | 12% $NaHCO_3$ |
| Electrolyte Flow Rate | 8.5 L/min nominal flow rate |
| Travel Speed | 30 fpm up 225 fpm |
| Reactor Length | 2.5 meters |
| Plasma Zone [active length] | 2.35 meters |
| Voltage DC Range | 140 VDC [stable condition] |
| Amperage Range | 90 |

Example 10

The exposed head of a stainless steel bolt which had a matte gray dull finish was placed inside the reactor during the cleaning of 5.5 mm wire rod. After processing for approximately five (5) minutes the stainless steel bolt was removed and examined. The exposed bolt head exhibited a very smooth, highly polished surface.

| | |
|---|---|
| Electrolyte Temperature | 80° C. |
| Electrolyte Concentration | 10% $NaHCO_3$ |
| Electrolyte Flow Rate | 1.75 L/min |
| Voltage | 180 VDC |
| Amperage | |

Example 11

A plate or block of Inconel 718 [anode] [0.750"×1"×4"] material was installed within the reactor chamber and electrolyte was flowed over the block of Inconel 718 for approximately minutes in total time (not constant flowing) causing the Inconel 718 block to exhibit a reduced and/or modified surface. By directing the flow pattern the erosion area can be controlled, as exhibited in this example; the flow was directed across the center of the Inconel 718 block, and upon completion a smooth, even channel had been reduced from the center of the Inconel 718 block of material. Processed material, square rod, carbon steel 95 mm edge length was coated during the test.

| | |
|---|---|
| Electrolyte Temperature: | 70° C. |
| Electrolyte Concentration: | 15% $ZnSO_4$ |
| Electrolyte Flow Rate: | 11 L/min nominal flow rate |
| Voltage: | 170 VDC |
| Amperage: | 100 A |
| Weight Loss of Inconel 718: | 4 grams at top anode/10 grams at bottom anode [+/−18 seconds] |
| Deposition Rate: | 0.8 μm/second |
| Coating: | Ni, Cr, Fe & Zn |

Example 12

A tensile test sample of 4340 steel having notch in the center (length, 1.317 mm) was treated in a reactor with plasma forming of the surface. The surface of the sample was modified along with the notched region.

| | |
|---|---|
| Electrolyte Temperature | 70° C. |
| Electrolyte Concentration | 12% $NaHCO_3$, pH 9.4, |
| Electrolyte Flow Rate | 1 L/min nominal flow rate |
| Travel Speed | rotation, no linear speed |
| Voltage DC Range | 135 VDC [stable condition] |
| Amperage Range | 18-20 |

Example 13

A square rod, 95 mm edge length, having been previously cleaned with the electro-plasma process, is passed through a reactor with length 12" in which plasma formed and a coating of Zn was applied to the clean base metal. Reactor consisted of consumable anode assembly of IN 718 plates and Ni tubes. A significant loss in weight of anodes was observed. Dense coating consisted of Ni, Cr, and Fe along with Zn.

| | |
|---|---|
| Electrolyte Temperature | 70° C. |
| Electrolyte Concentration | 15% $ZnSO_4$ Monohydrate, pH 4. |
| Electrolyte Flow Rate | 11 L/min nominal flow rate |
| Travel Speed | 2.25 fpm |
| Reactor Length | 30 cm |
| Plasma Zone [active length] | 10 cm |
| Voltage DC Range | 170 VDC [stable condition] |
| Amperage Range | 100 |
| Deposition Rate: | 0.8 μm/second |
| Loss in weight of plate anode | 4 g (Top) and 10 g (Bottom) for a run of ~18 sec |

Example 14

A square tube, 2.54 cm edge length, having been previously cleaned with the electro-plasma process, is passed through a reactor with length 5.5" in which plasma formed and a coating of Mo was applied to the clean base metal. Surface of the steel tube was alloyed with Mo. Concentration of Mo on the surface could be varied depending upon processing time and electrolyte make up. One of the examples is shown below:

| | |
|---|---|
| Electrolyte Temperature | 70° C. |
| Electrolyte Concentration | 15% $Na_2MoO_4$ |
| Electrolyte Flow Rate | 2 L/min nominal flow rate |
| Reactor Length | 14 cm |
| Voltage DC Range | 120 VDC [stable condition] |
| Amperage Range | 30 |
| Treatment Time: | 5 min |
| Mo concentration on surface | 35% |

Example 15

A square tube, 2.54 cm edge length, having been previously cleaned with the electro-plasma process, is passed through a reactor with length 5.5" in which plasma formed and a coating of Zn—Mo alloy was applied to the clean base metal. Concentration of Mo in Zn coating could be varied depending upon processing time and electrolyte make up. One of the examples is shown below:

| | |
|---|---|
| Electrolyte Temperature | 70° C. |
| Electrolyte Concentration | 10% $ZnSO_4$ Monohydrate, pH: 5.0 |
| Additions in electrolyte | Either $Na_2MoO_4$ or Mo powder |
| Electrolyte Flow Rate | 2 L/min nominal flow rate |
| Reactor Length | 14 cm |
| Voltage DC Range | 120 VDC [stable condition] |
| Amperage Range | 30 |
| Treatment Time: | 1 min |
| Mo concentration in coating | 20% |

Example 16

A wire strand, diameter 0.96 mm, consisting 18 fine Cu wires coated with Ni, is passed through a reactor with length 12" in which plasma formed to remove oxide from Ni coating. Oxide was removed from the Ni surface of wire.

| | |
|---|---|
| Electrolyte Temperature | 70° C. |
| Electrolyte Concentration | 12% $NaHCO_3$ pH: 8.3. |
| Electrolyte Flow Rate | 5 L/min nominal flow rate |
| Travel Speed | 40-60 fpm |
| Reactor Length | 30 cm |
| Plasma Zone [active length] | 26 cm |
| Voltage DC Range | 125 VDC [stable condition] |
| Amperage Range | 14-17 |

Example 17

A fine brass coated steel wire, diameter 350 μm, is passed through a reactor with a length of 2" of plasma forming on wire surface. Zn—Ni alloy coating was applied to the base metal.

| | |
|---|---|
| Electrolyte Temperature | 70° C. |
| Electrolyte Concentration | 15% $ZnSO_4$ Monohydrate, pH: 5.0 |
| Additions in electrolyte | 15% $NiSO_4$ hexahydrate, pH: 4.8 |
| Electrolyte Flow Rate | 150 ml/min nominal flow rate |
| Travel Speed | 7 fpm |
| Reactor Length | 5 cm |
| Plasma Zone [active length] | 3.8 cm |
| Voltage DC Range | 116 VDC [stable condition] |
| Amperage Range | 1.7-2 A |
| Treatment Time: | 0.4 sec |
| Deposition Rate | 0.65 μm/second |

I claim:

1. An improved process for treating an electrically conductive surface of a workpiece by cleaning or coating the surface, comprising the steps of: deploying the electrically conducting surface of the workpiece to form a cathode in an electrolytic cell; establishing a DC voltage between the cathode and an anode in excess of 30V; forming a working gap between the anode and the cathode, and establishing a seal around the working gap to form a sealed treatment zone; delivering into the working gap an electrically conductive medium selected from the group consisting of: (A) an aqueous electrolyte from which a foam is created; (B) a foam; and (C) a mixture of components (A) and (B), so that electrically conductive medium consisting of a foam comprising a gas/vapor phase and a liquid phase fills the working gap, wherein said electrically conductive medium enters the electrolytic cell through tubes having discharge ends oriented at approximately ten degrees from parallel to the workpiece, wherein the tubes are electrically conductive and are anodically charged, and wherein turbulence is created within the electrolytic cell; adjusting the operating parameters so that an electro-plasma discharge is created between the cathode and positive ions in the electrically conductive medium which are concentrated near the electrically conducting surface of the workpiece, thereby causing micro-zonal melting of the surface sufficient to create a predetermined micro-relief profile of the surface; and removing foam from the working gap.

* * * * *